US005630276A

United States Patent [19]

Weinstein

[11] Patent Number: 5,630,276

[45] Date of Patent: May 20, 1997

[54] EATING UTENSIL

[76] Inventor: Alex H. Weinstein, 4403 W. Grace St., Richmond, Va. 23230

[21] Appl. No.: 281,117

[22] Filed: Aug. 16, 1994

[51] Int. Cl.[6] ..... A47J 43/28

[52] U.S. Cl. ..... 30/324

[58] Field of Search ..... 30/142, 321, 323, 30/324, 340, 322

[56] References Cited

U.S. PATENT DOCUMENTS

| | | | |
|---|---|---|---|
| 659,341 | 10/1900 | Dodd et al. . | |
| 843,372 | 2/1907 | Smith . | |
| 1,545,365 | 7/1925 | Throm . | |
| 2,505,122 | 4/1950 | Krieger, Jr. | 30/324 |
| 2,602,996 | 7/1952 | Piche . | |
| 2,636,266 | 4/1953 | Sweet . | |
| 2,682,705 | 7/1954 | Johnson . | |
| 2,741,027 | 4/1956 | Margolin . | |
| 2,809,426 | 10/1957 | Pickering . | |
| 4,028,803 | 6/1977 | Currie . | |
| 4,325,187 | 4/1982 | Wasson . | |
| 4,389,777 | 6/1983 | Landsberger . | |
| 4,433,950 | 2/1984 | Hanger et al. . | |
| 4,599,797 | 7/1986 | Bax . | |
| 4,993,156 | 2/1991 | Craven . | |
| 5,037,261 | 8/1991 | Morewood . | |
| 5,282,711 | 2/1994 | Frische . | |

FOREIGN PATENT DOCUMENTS

| | | | |
|---|---|---|---|
| 2005351 | 8/1971 | Germany | 30/324 |
| 2136274 | 9/1984 | United Kingdom | 30/324 |

*Primary Examiner*—Hwei-Siu Payer

[57] ABSTRACT

An eating utensil is described which is intended to enable disabled persons and infants to feed themselves. A spoon according to this invention is self-leveling due to a counter weight linked to the spoon of the bowl through the handle. The spoon provides enhanced stability because the bowl for holding food is free to move with two degrees of rotational freedom with respect to the handle of the spoon. This results in a spoon which is very forgiving of the decreased motor skills of individuals who have been injured, or are suffering the effects of certain diseases, or are merely young children struggling to master cutlery.

17 Claims, 6 Drawing Sheets

EATING UTENSIL

FIELD OF THE INVENTION

This invention relates to the field of cutlery. More specifically, this invention relates to the art of helping persons having undeveloped, reduced, or impaired motor skills to feed themselves.

BACKGROUND OF THE INVENTION

Many people find it difficult to feed themselves with conventional cutlery due to their physical status. Young children may find it frustrating to try to emulate their parents' use of forks and spoons at the dinner table. More often, the parents of those children have found it taxing to endure the constant spillage of food while indoctrinating the youngsters in the proper use of the forks and spoons. Before the age of eighteen months, many children are still struggling to develop the physical coordination necessary to master adult-style eating habits.

Adults may also have trouble using common cutlery. Some diseases, such as cerebral palsy (CP) and Parkinson's, and injuries to the spinal column can result in partial impairment of motor skills which make feeding one's self difficult, if not impossible. Parkinson's and CP cause uncontrollable tremors in the arms which make it difficult to hold liquid on a spoon or to aim a fork at a given piece of food. Spinal column injuries (or other kinds of nerve damage for that matter) can result in an ability to only partially control the movement of the arms; the possible range of motion is likely limited and eye-to-hand coordination may be affected. Other people are challenged by conditions caused by severe arthritis or arm injuries which simply limit the useful range of motion of their arms.

In the past, attempts have been made to solve these problems. The proposed solutions range from being very simple to very complex.

1) The Self-Leveling Spoons

So-called "self-leveling spoons" of various designs have been proposed to help disabled persons and young children feed themselves without spilling food excessively. U.S. Pat. No. 659,341 shows a self-leveling spoon which has a bowl 4 which rotates with respect to the handle 8. It has a single degree of rotational freedom about the longitudinal axis of the handle of the spoon. U.S. Pat. No. 2,682,705 shows a self-leveling spoon which has a bowl 1 which rotates with respect to the handle 6. It has a single degree of rotational freedom about the longitudinal axis of the handle of the spoon. It has a stop 10 which inhibits full 360 degree rotational freedom. U.S. Pat. No. 2,809,426 shows a self-leveling spoon which has a bowl 12 which rotates with respect to the handle 14. It has a single degree of rotational freedom about the longitudinal axis of the handle of the spoon. U.S. Pat. No. 4,389,777 shows a self-leveling spoon which has a bowl 4 which rotates with respect to the handle 2. It has a single degree of rotational freedom about the longitudinal axis of the handle of the spoon. It has sand or pebbles 62 inside the handle for weighting purposes. British patent document no. 833,889 (published May 4, 1960) and German patent document no. 2,005,351 (published Aug. 19, 1971) each show self-leveling spoons with a single degree of rotational freedom along the longitudinal axis of the spoon handle.

Some self-leveling spoon designs provided some means selectively holding the bowl of the spoon fixed with respect to the handle. U.S. Pat. No. 2,636,266 shows a spoon which has a bowl 1 which is selectively rotatable with respect to the handle 3. Rotation is along the longitudinal axis of the handle. Rotation is selectively inhibited by a mechanism internal to the handle (see elements 4, 14, 28 in FIGS. 3, 4, 6). U.S. Pat. No. 2,741,027 shows a spoon which has a bowl 16 which is selectively rotatable with respect to the handle 12. Rotation is along the longitudinal axis of the handle. Rotation is selectively inhibited by a mechanism internal to the handle (see elements 60, 62, 63, 74, 76, 78 in FIG. 10). U.S. Pat. No. 4,028,803 shows a self-leveling spoon which has a bowl 20 which rotates with respect to the handle 22. It has a single degree of rotational freedom about the longitudinal axis of the handle of the spoon. The disclosure emphasizes a mechanism for selectively inhibiting rotational movement of spoon with respect to the handle (see FIGS. 2 & 3). U.S. Pat. No. 4,993,156 shows a self-leveling spoon which has a bowl 10 which rotates with respect to the handle 24. It has a single degree of rotational freedom about the longitudinal axis of the handle of the spoon. The bowl is connected to a pendulum weight 22 which is located at the opposite end of the handle from the bowl. It also discloses a selectable locking mechanism 30, 32, 34.

It has been proposed to fasten a self-leveling spoon to the hand of the user with straps. U.S. Pat. No. 4,325,187 shows a self-leveling spoon which discloses a strap system (see especially element 12 in FIG. 5) for fastening the handle of the spoon to the user's hand. The bowl 18 has only a single degree of rotational freedom with respect to the handle 20, 32.

The most glaring limitation of the self-leveling spoons proposed thus far is the ability to rotate about only one axis. These spoons will operate marvelously if the axis of rotation of the user's hand happens to coincide precisely with the longitudinal axis of the spoon. If the user fails to accomplish this coincidence, the spoon will spill its contents just like an ordinary spoon. For most persons with impaired or undeveloped physical capacities, this is just too much to ask.

2) The Technically Complex Proposals

In the last decade, solutions of increasing sophistication have been proposed. U.S. Pat. No. 4,433,950 shows a motorized self-feeding apparatus which has a spoon B which is moved about by a complex mechanical linkage system (see FIGS. 1 & 3). U.S. Pat. No. 5,037,261 shows a motorized self-feeding apparatus which has a spoon 20 which is moved about by a complex mechanical linkage system. FIGS. 2 & 3 are most illustrative. U.S. Pat. No. 5,282,711 shows a robotic self-feeding apparatus which has a spoon 64 which is moved about by a complex mechanical linkage. The system is computer controlled. The devices proposed by these disclosures are of such a high level of complexity and sophistication that they would cost at least two orders-of-magnitude more to manufacture than ordinary spoons.

3) Other Miscellaneous Inventions

Forks have been disclosed which have tine portions which rotate with respect to their handles. However, it does not appear that these would be particularly helpful to persons with impaired motor skills. These inventions are directed toward solving the particular problem of eating spaghetti. U.S. Pat. No. 2,602,996 shows a fork which a prong and shank section 14 which rotates with respect to the handle 13. Rotation is along the longitudinal axis of the handle and is controlled by the user at thumb wheel 15. U.S. Pat. No. 4,599,797 shows a fork which a prong and shank section 14 which rotates with respect to the handle 12. Rotation is along the longitudinal axis of the handle and is controlled by the user at thumb wheel 18.

One dipping device has been proposed which allows rotation of the bowl with respect to the handle about plural axes. U.S. Pat. No. 1,545,365 shows a skimmer ladle which has a bowl 4 which rotates with respect to the handle 5. It has two degrees of rotational freedom which are about the orthogonal axes which are transverse to the longitudinal axis of the handle of the ladle. Rotation is controlled by the user via controls 20, 15, 10, 12. Although this ladle does allow movement with two degrees of rotational freedom, it has no self-leveling structure to prevent spilling.

OBJECTS OF THE INVENTION

It is an object of this invention to provide a device which helps persons who have underdeveloped, reduced, or impaired motor skills to more readily feed themselves.

It a further object of this invention to provide a cutlery item which has a working end which remains in a fixed angular orientation with respect to the earth, regardless of the orientation of the hand holding the item.

It yet a further object of this invention to provide a spoon, fork, or knife which has a self-leveling functionality and which allows rotational movement of the working end with respect to the handle about two orthogonal axes.

It yet a further object of this invention to provide a self-leveling cutlery device which allows rotational movement of the working end with respect to the handle about two orthogonal axes, and which may selectively adjusted about a third axis which is orthogonal to the other axes.

It is also an object of this invention to provide a self-leveling cutlery device which allows rotational movement of the working end with respect to the handle about two orthogonal axes, and which may be selectively locked so as to inhibit all such rotational movement.

It is also an object of this invention to provide an apparatus for maintaining the levelness of an object to be carried by a person.

BRIEF SUMMARY OF THE INVENTION

The invention is directed towards an eating utensil which is to be gripped by (or perhaps strapped to) a hand of a user. The eating utensil according to this invention provides the user with a food holding platform which will remain in a relatively stable angular orientation while the user is moving the food between the table and their mouth. This stability is maintained regardless of the angular orientation of the hand gripping the spoon. In other words, the only rotational motion which is transferred to the food holding platform from the handle is that about the vertical axis. Thus, the platform is always level. All elements of translational motion of the hand are transferred to the food holding platform.

This leveling functionality is accomplished by two structures working in conjunction with one another. First, the isolation of rotational motion from translational motion results because an isolating means allows two degrees of rotational freedom between the surface gripped by the hand and the food holding platform. Second, the angular stability of the food holding platform is due to a stabilizing means which has a counter weight which is linked to the platform.

Since two of the rotational elements of the motion of the gripping hand are rendered irrelevant by this invention, the task of moving the utensil from the plate to the mouth without spilling the food is greatly simplified. Using this invention, the user need only concentrate on performing the proper translational elements of the feeding motion without worrying about coordinating the rotational elements of the motion as well.

In addition, the stabilizing effect provided by the invention makes it possible for persons with tremors to feed themselves without shaking the better part of the food from the utensil. The total effect of the features of the invention provide a utentsil which is non-spilling.

As an illustration of how the present invention operates, it is helpful to make an analogy to aircraft motion. When an aircraft rotates about its longitudinal axis (running from nose to tail), such rotation is called "roll." When an aircraft rotates about its lateral axis (running from wingtip to wingtip), such rotation is called "pitch." And, when an aircraft rotates about its vertical axis (running from the top to the bottom of the fuselage), such rotation is called "yaw." If, by analogy, one considers the working end of the eating utensil to correspond to the nose of the aircraft, and the handle to correspond to the fuselage, then the rotational aspects of the eating utensil's motion may be more intuitively analyzed. The handle of the utensil may be caused to rotate about any of the pitch, roll, and yaw axes in any combination by the simple input of motion from the hand holding the handle. However, the working end of the utensil does not follow all the elements of the handle's rotation. The working end does not pitch. It does not roll. This means it always stays level. The only other element of rotational motion, yaw, does transfer from the handle to the working end.

Another element of the invention is a selective locking structure which acts to inhibit the self-leveling action of the utensil for the temporary purpose of making it easier to scoop, stab, or otherwise capture food on the utensil. When the utensil is brought into an attitude for scooping at the table, the locking structure engages each of the cooperating isolating means and stabilizing means so that the whole utensil is temporarily frozen so as to act like an ordinary single piece eating utensil. When the utensil is raised from the plate, the isolating means and stabilizing means are freed to act and the utensil resumes its previous functions.

It is contemplated that this invention may be used by handicapped persons and small children to enable them to feed themselves. Restaurants may keep a stock of these utensils for use at their customers' request as partial compliance with The Americans With Disabilities Act.

It is also contemplated that this invention may be used broadly to help a person hold most anything level such as a cup of coffee or a video camera.

DETAILED DESCRIPTION OF THE INVENTION

It is contemplated to embody the invention as either a spoon, or as a fork, or as a knife, or any utensil or tool that requires self leveling. However, for the sake of clarity, the illustrative description is consistently phrased for the spoon embodiment only. The spoon working end referred to in the following description could be supplanted by the working end of any hand-held implement.

Figure 1A:
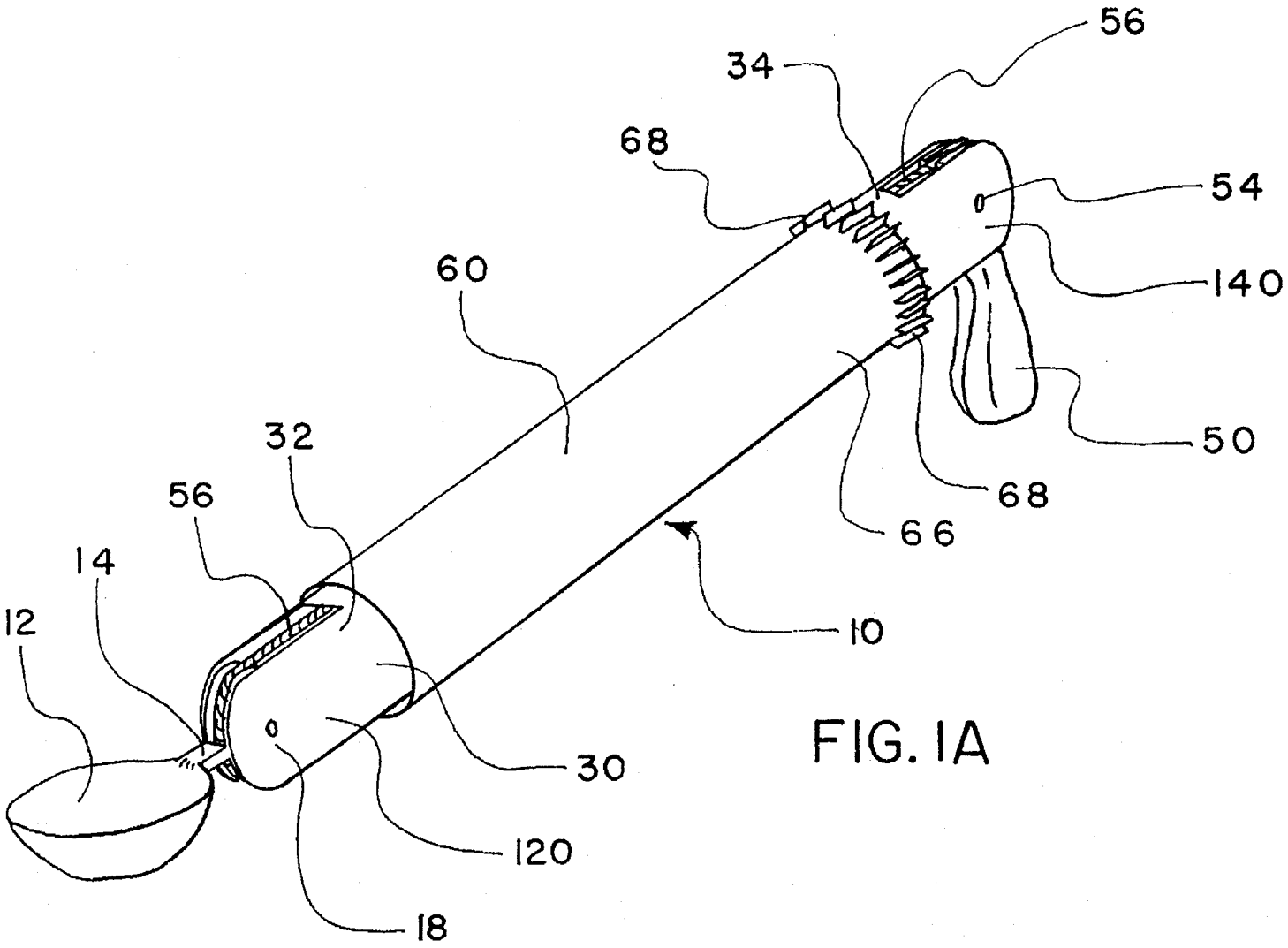
FIG. 1A is a perspective view of the invention according to the preferred embodiment.
Figure 1B:
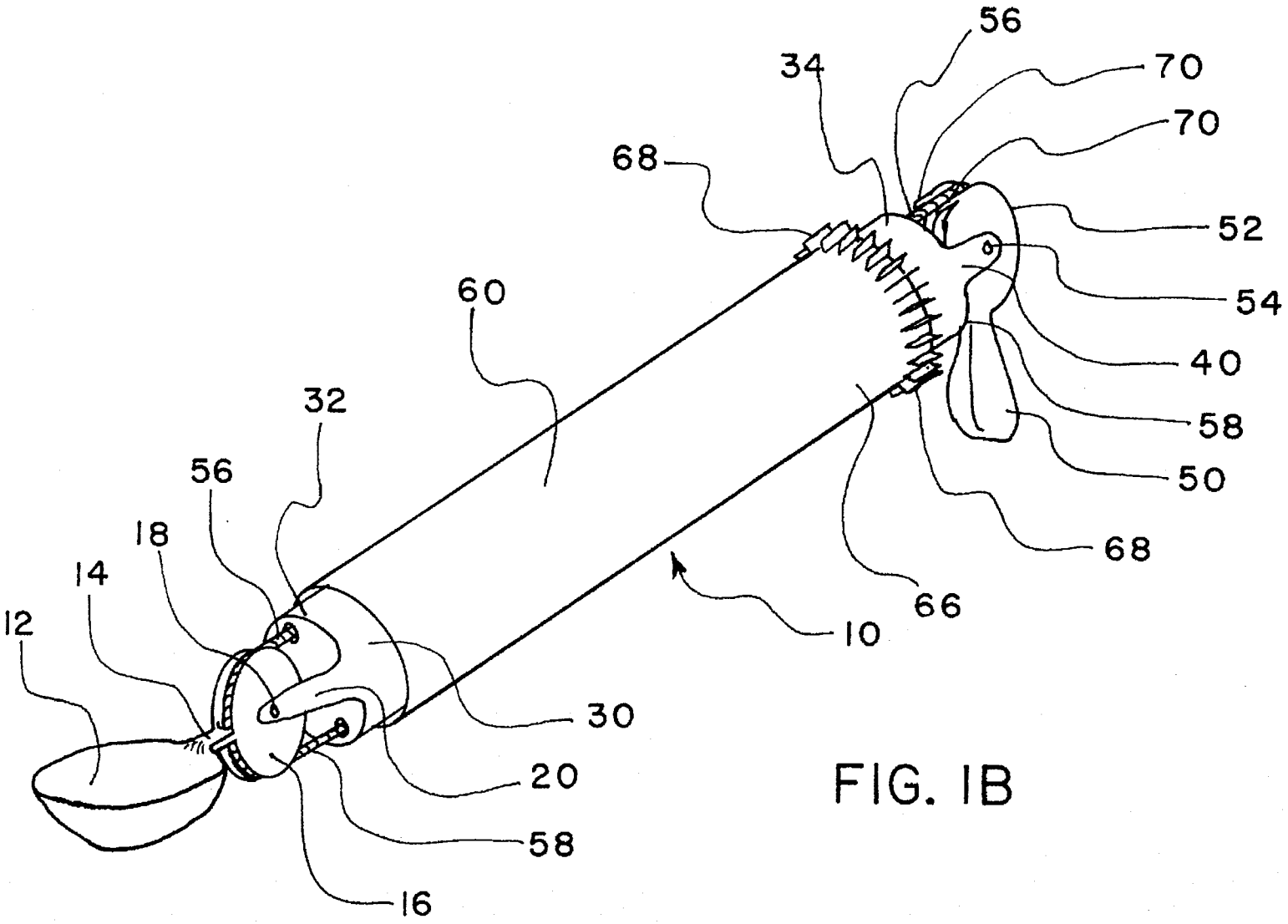
FIG. 1B is a perspective view of the invention according to one of the alternate embodiments.
Figure 2A:
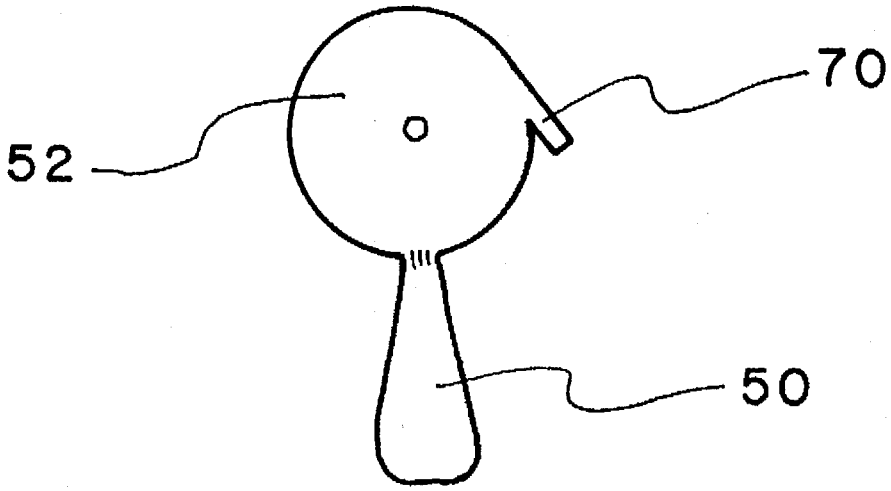
FIG. 2A is a side view of the rear pulley and counter weight according to the preferred embodiment.
Figure 2B:
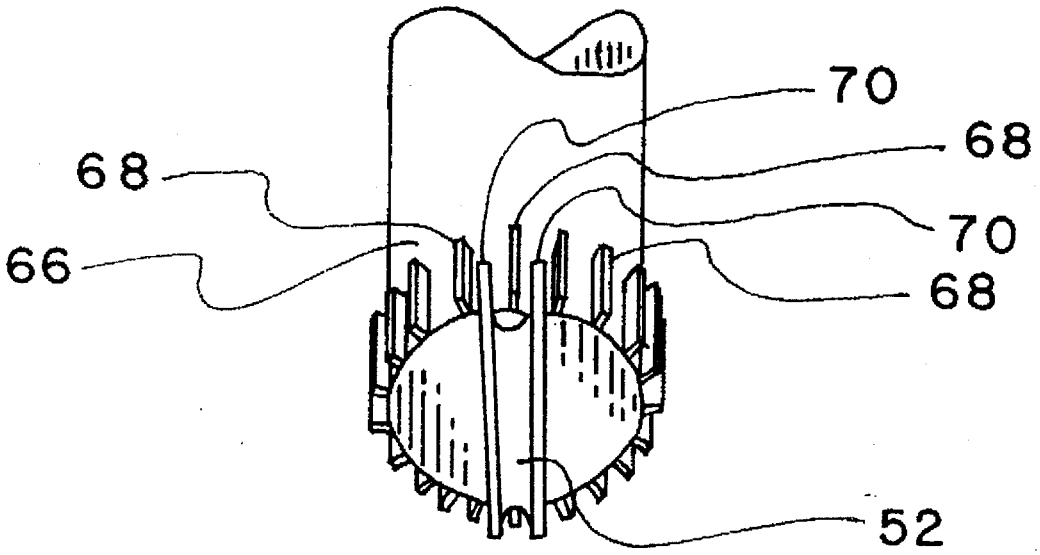
FIG. 2B is a top view of the rear pulley and counter weight according to the preferred embodiment.

The perspective view of FIG. 1B illustrates one of the embodiments of the invention. The spoon 10 has a bowl 12 for scooping and holding food. The bowl 12 is connected by a shank 14 to the front pulley 16 which rotates about the front shaft 18. The front shaft 18 is mounted on the front shaft supports 20 which extend outward from the proximal end 32 of the elongate main body 30 of the spoon 10. At the distal end 34 of the main body 30, the rear shaft 54 is mounted on the rear shaft supports 40 which extend outward from the distal end 34 of the elongate main body 30 of the spoon 10.

Figure 7:
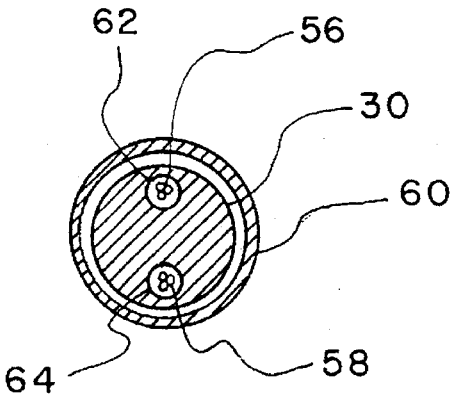
FIG. 7 is a sectional view of the invention according to the embodiment of FIG. 1.

At the distal end of the spoon 10, a counter weight 50 hangs from the rear pulley 52. The rear pulley 52 rotates about the rear shaft 54. The front pulley 16 and the rear pulley 52 are linked to one another by cables 56, 58 which are disposed so as to move freely through the entire length of the main body 30. The main body 30 can be hollow, or (see FIG. 7) it can be solid with a pair of lumens 62, 64 extending longitudinally therethrough for the cables 56, 58 to pass. This results in the bowl 12 and the counter weight 50 being linked together in a fixed angular relationship to one another. This structural linking of the bowl 12 to the counter weight 50 provides the stabilizing functionality of the invention.

Surrounding a substantial portion of the main body 30 is a handle 60 which is intended to be gripped by the hand of the user. Alternatively, the handle 60 may be fastened to the user's hand by a strap (not shown). The handle 60 may rotate about the main body 30 with no restrictions on its range of motion. The handle 60 is free to slide back and forth (longitudinally) on the main body 30 only a short distance. The rotation of the handle 60 about the body 30 in conjunction with the rotation of the front pulley 16 provide the isolation functionality of the invention.

At the distal end 66 of the handle 60 is a row of radially extending vanes 68 which act as one half of the motion inhibiting means of the invention. The other half of the motion inhibiting means is the pair of catches 70 mounted on the rear pulley. The vanes 68 and the catches 70 act so as to interlock with one another when the spoon 10 is tilted with the bowl 12 in a lowered position so as to scoop up food. When the spoon 10 is tilted downward, gravity acts to pull the body 30 of the spoon down and forward through the handle 60, thus causing the handle 60 to move closer to the rear pulley 52. When the handle 60 contacts the rear pulley 52, the vanes 68 engage the catches 70.

FIG. 1A shows a perspective view of the invention according to the preferred embodiment. It is identical in structure and function to the embodiment shown in FIG. 1B, as described above, except that the shaft supports 120, 140 are larger. The larger shaft supports 120, 140 are shaped to cover the pulleys 16, 52 so that the pulleys 16, 52 cannot be directly contacted by the user; the pulleys 16, 52 are still capable of the same range of rotation as those of the embodiment of FIG. 1B.

Figure 3A:
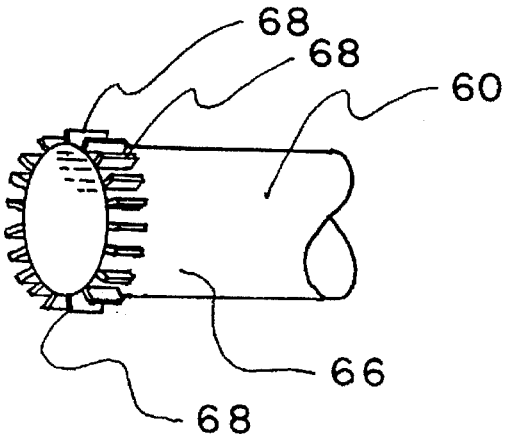
FIG. 3A is a detail of the rear end of the handle according to the preferred embodiment.
Figure 3B:
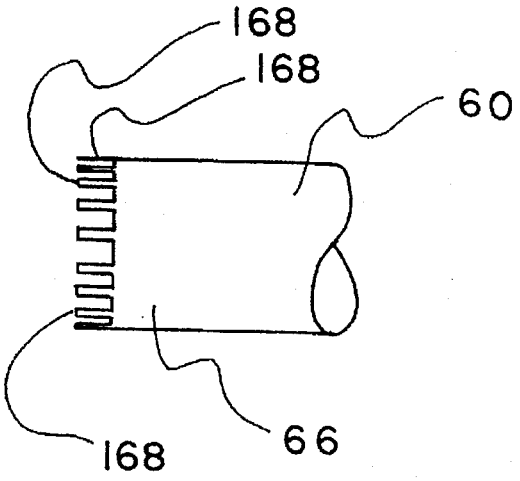
FIG. 3B is a detail of the rear end of the handle according to an alternate embodiment.

FIG. 3B shows an alternate embodiment of the motion inhibiting means. At the rear (or distal) end 66 of the handle 60, projections 168 extend longitudinally out from the handle 60. These longitudinal projections 168 may engage corresponding elements on the rear pulley 52 to inhibit the motion of the spoon 10.

Figure 4A:
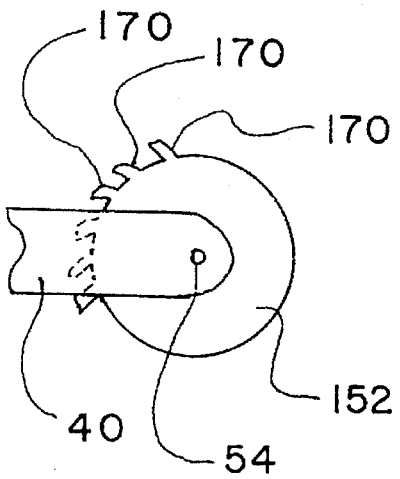
FIGS. 4A through 4C are details of the rear pulley according to an alternate embodiments.

FIGS. 4A–4E illustrate alternate embodiments of the motion inhibiting means. FIG. 4A shows the rear pulley 152 with plural pairs of catches 170 to inhibit the self-leveling motion at various angles, thereby allowing for the flexibility of the spoon 10 to be used for scooping food at various angles. It is contemplated that this pulley embodiment will work advantageously in cooperation with the handle embodiments according to either FIGS. 3A or 3B.

Figure 4B:
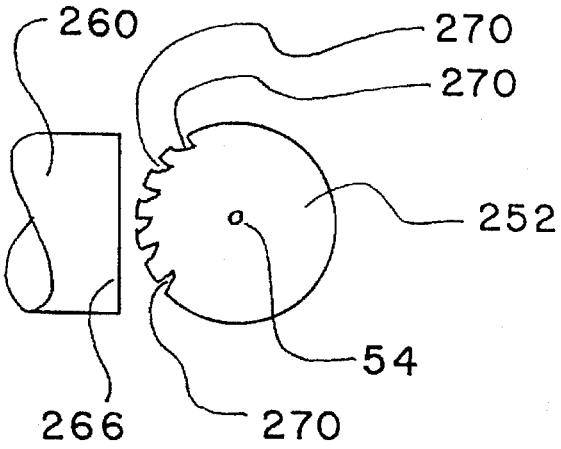
Figure 4C:
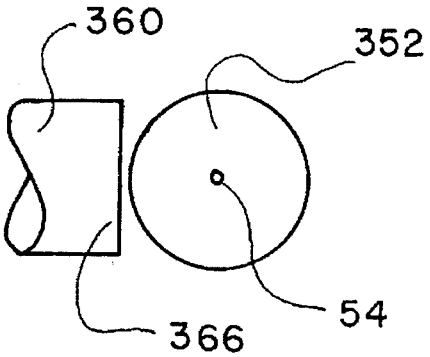
Figure 4D:
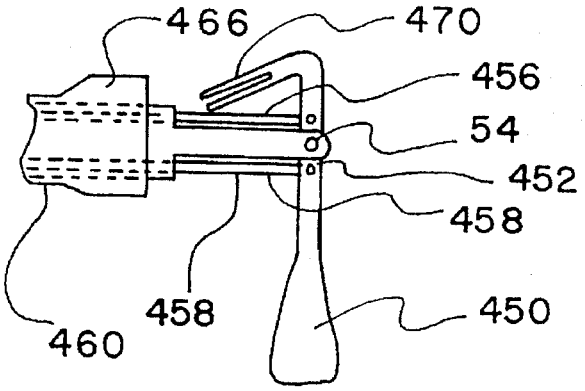
FIG. 4D is a detail of the rear linkage according to an alternate embodiment.
Figure 4E:
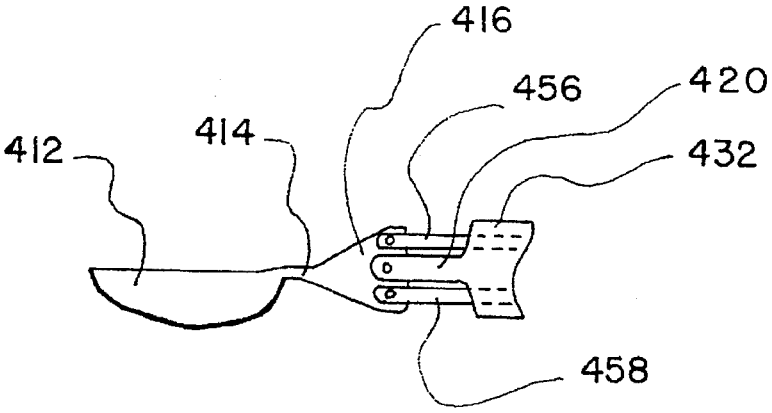
FIG. 4E is a detail of the front linkage according to an alternate embodiment.

FIG. 4B shows the rear pulley 252 with a plurality of notches 270 for receiving the distal end 266 of the handle 260. It is contemplated that this pulley embodiment will work advantageously with the handle embodiment according to FIG. 3A or a handle 260 having no extending vanes or projections at all. FIG. 4C shows the rear pulley 352 with no catches or notches; this embodiment depends upon friction alone between the handle 360 and the rear pulley 352 to inhibit motion. It is contemplated that this pulley embodiment will work advantageously with a handle 360 which has no extending vanes or projections at its distal end 366. FIG. 4D shows a fork 470 mounted on the rear pulley 452 which engages a flared portion 466 of the distal end of the handle 460. This embodiment uses a mechanical linkage with an upper link member 456 and a lower link member 458, each connecting to the rear pulley member 452 from which the weight 450 is supported. The fork 470 is formed of a pair of tine members separated by a notch. FIG. 4E shows a front linkage with an upper link member 456 and a lower link member 458, each connecting to a front pulley member 416. The bowl 412 is supported from member 416 by shank 414. The structural relationships of the elements of this linkage embodiment with the front shaft support member 420 and the inner cylinder 432 are analogous to that of the other embodiments. That is to say, the linkage members 456 and 458 are disposed inside of and parallel to the inner cylinder 432.

Figure 5:
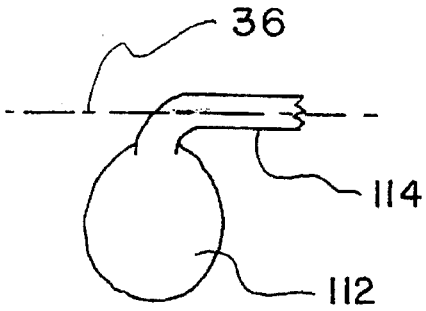
FIGS. 5 and 6 are details of the shank and bowl of the spoon according to alternate embodiments.

FIG. 5 shows an alternate embodiment of the bowl 112 and shank 114 portion of the spoon 10. The shank 114 is formed so that the bowl 112 is aligned at an angle with the longitudinal axis 36 of the main body 30 which approaches ninety degrees. This would be a desirable configuration particularly for persons who have very limited range of motion in their wrists.

Figure 6:
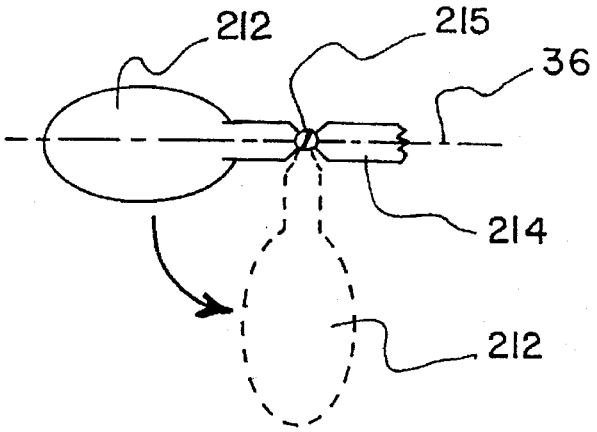

FIG. 6 shows a further alternate embodiment of the bowl 212 and shank 214 portion of the spoon. An adjustment means 215 is provided which allows the angle of the bowl 212 with respect to the longitudinal axis 36 of the body 30 to be adjusted to suit the needs of the individual user. A machine screw 215 is shown for illustration purposes, although any equivalent fastening means would suffice.

Figure 8:
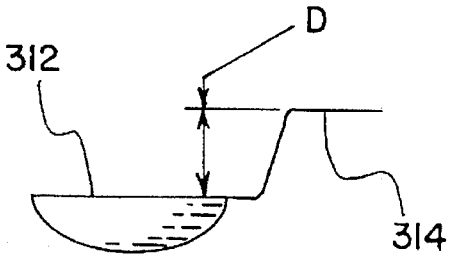
FIG. 8 is a detail of the shank and bowl of the spoon according to an alternate embodiment.

FIG. 8 shows yet another alternative embodiment of the bowl 312 and shank 314 portion of the spoon. The shank 314 is formed so as to offset the bowl 312 from the handle 60 by a predetermined vertical distance D. This distance may be adjustable.

The bowl 12 of the spoon 10 may be embodied as a combination of a spoon and fork, popularly known as a "spork." To realize this embodiment, the proximal periphery of the bowl of the spoon is modified to have three notches in it. This results is a spoon which has small fork-like tines on its leading edge.

It is contemplated that the utensil may be made of most any solid material which is biocompatible and which is sufficiently robust to maintain its structural integrity even when used on hot or cold foods, or in hot dishwashers. More specifically, it is conceived to make most of the components of the utensil from metals, such as brass or stainless steel; or from plastics, such as nylon, polyethylene, or polytetrafluoroethylene (Teflon (TM)).

The mechanical communication between the front pulley 16 and the rear pulley 52 may be embodied as a solid mechanical linkage 456, 458 or, alternatively as a thin cable 56, 58 having high tensile strength. The thin cable 56, 58 may be made from metal or a plastic (such as Kevlar (TM)) or any other material with relatively low stretch. It is also conceived that the cable may be relatively elastic, although this is not a preferred embodiment. The cable may also be embodied as two separate pieces of cable which are each fastened to both pulleys. The cables may be fastened to the pulleys by any of the follow means: hooks and loops; threaded fasteners; ball screws inserted into and secured in keyhole receptacles.

The handle may be provided with knurling (not shown) to make the utensil easier to grip. The handle may also be provided with a strap to fasten the utensil onto the hand of a person with marginal or inconsistent grip strength. The main body may be embodied as having a broad range of different lengths. It may be as short as a couple inches for a spoon for infants. It may be about six inches long for an adult-size spoon. And it may be as long as two feet or more; this extra-long length is intended to accommodate the needs of persons whose range-of-motion limitations prevent them from moving their hands close to their mouths.

The counter weight may be comprised of any relatively heavy material. Lead, iron, and bismuth are contemplated. However, if a toxic metal such as lead is used, it should be securely coated with plastic to render the apparatus non-toxic. The weight may be placed entirely within a one-third sector of the rear pulley, rather than hanging down as illustrated.

The invention is also envisioned to encompass devices which help to hold any object level. The working end of the device may be constructed so as to fasten to an object such as a coffee cup or a video camera. The counter weight may be constructed so as to allow mass to be added or subtracted according to necessity. The video camera embodiment of the invention may be modified to be shoulder mounted.

While a preferred embodiment of the invention has been described using specific terms, such description is for illustrative purposes only, and it is to be understood that changes and variations may be made without departing from the spirit or scope of the following claims.

What is claimed is:

1. An eating utensil comprising:

an elongate main body having a longitudinal axis and proximal and distal ends;

a handle having proximal and distal ends which substantially surrounds said main body and is free to move with respect to said main body;

a working portion which is connected to the proximal end of said main body and is free to rotate with respect to said main body;

a weighted portion which is connected to the distal end of said main body and is free to rotate with respect to said main body; and a mechanical link which is disposed parallel to the longitudinal axis of said main body and which is connected to both the working portion and the weight portion;

whereby said working portion is held relatively level regardless of the angular orientation of said handle.

2. The eating utensil according to claim 1 further comprising:

a plurality of vanes attached to the distal end of said handle; and catches attached to said weighted portion;

whereby said vanes and said catches may mechanically engage one another when the eating utensil is held such that said working portion is substantially lower than the rest of the eating utensil.

3. The eating utensil according to claim 1 further comprising:

a plurality of protrusions attached to the distal end of said handle; and a notched member attached to said weighted portion;

whereby said protrusions and said notched member may mechanically engage one another when the eating utensil is held such that said working portion is substantially lower than the rest of the eating utensil.

4. A spoon which has a handle and a bowl and is non-spilling, and which includes a means for maintaining said bowl in a level orientation regardless of the angular orientation of said handle, wherein said maintaining means functions to provide at least two degrees of rotational freedom between said bowl and said handle, whereby persons are enabled to feed themselves more easily.

5. The spoon according to claim 4, wherein said maintaining means functions to allow said bowl to rotate only about an axis which is perpendicular to the earth's surface.

6. The spoon according to claim 4, further including:

a means for inhibiting said means for maintaining, whereby the spoon is selectively disabled from functioning as self-leveling.

7. The spoon according to claim 6, wherein said inhibiting means functions to inhibit said means for maintaining when the spoon is tilted so that said bowl is in a lowered position consistent with scooping.

8. An eating utensil comprising:

a means for holding food;

a handle;

a means for coupling said holding means to said handle so that said holding means moves freely with at least two rotational degrees of freedom with respect to said handle; and a means for maintaining said holding means at a substantially consistent angular orientation with respect to earth regardless of the angular orientation of the handle.

9. The eating utensil according to claim 8, further comprising:

a means for simultaneouslly inhibiting said means for coupling and said means for maintaining.

10. The eating utensil according to claim 9, wherein said inhibiting means functions to inhibit said means for coupling and said means for maintaining when the eating utensil is tilted so that said holding means is in a lowered position consistent with scooping.

11. The eating utensil according to claim 9, wherein said means for simultaneously inhibiting comprises:

a plurality of protrusions attached to a distal end of said handle; and a notched member attached to said means for maintaining.

12. The eating utensil according to claim 8, wherein said means for maintaining comprises:

a mechanical linkage having one or more linking members disposed within said handle.

13. The eating utensil according to claim 12, wherein there are two linking members.

14. An eating utensil comprising:

a means for holding food;

a handle;

a means for maintaining said holding means at a substantially consistent angular orientation with respect to earth regardless of the angular orientation of said handle; and a means for coupling said holding means to said handle so that said holding means is capable of moving freely with at least two rotational degrees of freedom with respect to said handle.

15. The eating utensil according to claim 14, further comprising:

a means for simultaneously inhibiting said means for coupling and said means for maintaining.

16. The eating utensil according to claim 15, wherein said inhibiting means functions to inhibit said means for coupling and said means for maintaining when the eating utensil is tilted so that said holding means is in a lowered position consistent with scooping.

17. An apparatus comprising:

a working end;

a handle;

a means for maintaining said working end at a substantially consistent angular orientation with respect to earth regardless of the angular orientation of the handle; and a means for coupling said working end to said handle so that said working end is capable of moving freely with at least two rotational degrees of freedom with respect to said handle.

* * * * *